US008297912B2

(12) United States Patent
Reed

(10) Patent No.: US 8,297,912 B2
(45) Date of Patent: Oct. 30, 2012

(54) FAN CASING FOR A GAS TURBINE ENGINE

(75) Inventor: Julian M. Reed, Derby (GB)

(73) Assignee: Rolls-Royce PLC, London (GB)

( * ) Notice: Subject to any disclaimer, the term of this patent is extended or adjusted under 35 U.S.C. 154(b) by 690 days.

(21) Appl. No.: 12/457,748

(22) Filed: Jun. 19, 2009

(65) Prior Publication Data

US 2010/0028130 A1 Feb. 4, 2010

(30) Foreign Application Priority Data

Jul. 29, 2008 (GB) ..... 0813821.6

(51) Int. Cl.
*F01D 25/24* (2006.01)

(52) U.S. Cl. ..... 415/9; 415/220

(58) Field of Classification Search ..... 415/9, 173.1, 415/220, 221; 416/2
See application file for complete search history.

(56) References Cited

U.S. PATENT DOCUMENTS

| | | | | |
|---|---|---|---|---|
| 6,290,455 | B1 * | 9/2001 | Hemmelgarn et al. | 415/9 |
| 6,619,913 | B2 * | 9/2003 | Czachor et al. | 415/119 |
| 7,114,912 | B2 * | 10/2006 | Gerez et al. | 415/9 |

FOREIGN PATENT DOCUMENTS

| | | | |
|---|---|---|---|
| GB | 2 361 032 | A | 10/2001 |
| GB | 2 416 192 | A | 1/2006 |
| GB | 2 422 407 | A | 7/2006 |
| GB | 2 426 287 | A | 11/2006 |

* cited by examiner

*Primary Examiner* — Ninh H Nguyen
(74) *Attorney, Agent, or Firm* — Oliff & Berridge, PLC

(57) ABSTRACT

A fan casing for a gas turbine engine has a fan track radially outward of the fan blades, and the fan track has sufficient strength and stiffness that, if a blade is released, it is broken up and deflected by the fan track rather than passing through to a containment system as in known arrangements. Optionally, a weakened region in the fan track may be provided, so that the leading edge portion of the blade will penetrate the fan track and be contained within the fan casing. This is particularly suitable for fan blades in which the stiffness and compressive strength are significantly higher in the leading edge region than in the remainder of the blade; for example, hollow metal fan blades or composite fan blades having a metal leading edge cap.

5 Claims, 5 Drawing Sheets

FAN CASING FOR A GAS TURBINE ENGINE

This invention relates to gas turbine engines, and more particularly to containment arrangements for fan casings of such engines.

Conventionally, the fan blades of a gas turbine engine rotate within an annular layer of abradable material, known as a fan track, within the fan casing. In operation, the fan blades cut a path into this abradable layer, minimising leakage around the blade tips.

The fan casing incorporates a containment system, generally radially outward of the fan track, designed to contain any released blades or debris if a fan blade should fail for any reason. The strength and compliance of the fan casing must be precisely calculated to absorb the energy of the resulting debris. It is therefore essential that the fan track should not interrupt the blade trajectory in a blade-off event, and therefore the fan track must be relatively weak so that any released blade or blade fragment can pass through it essentially unimpeded to the containment system.

Rearward of the fan track, there is conventionally provided an annular ice impact panel. This is typically a glass-reinforced plastic (GRP) moulding, or a tray or panel of some other material. It may also be wrapped with GRP to increase its impact strength. Ice that forms on the fan blades is acted on both by centrifugal and by airflow forces, which respectively cause it to move outwards and rearwards before being shed from the blade.

The geometry of a conventional fan blade is such that the ice is shed from the trailing edge of the blade, and it will strike the ice impact panel rearward of the fan track. The ice will bounce off, or be deflected by, the ice impact panel without damaging the panel.

Swept fan blades have a greater chord length at their central portion than conventional fan blades. Swept fan blades are increasingly favoured in the gas turbine industry as they offer significant advantages in efficiency over conventional blades. Because of their greater chordal length, ice that forms on such a blade, although it follows the same rearward and outward path as on a conventional blade, may reach the radially outer tip of the blade before it reaches the trailing edge. It will therefore be shed from the blade tip and strike the fan track.

However, a conventional fan track is not strong enough to tolerate ice impact, and so conventional arrangements are not suitable for use with swept fan blades. It is not possible simply to strengthen the fan track to accommodate ice impact, because this would disrupt the blade trajectory during a blade-off event, and compromise the operation of the fan casing containment system.

The gas turbine industry has also favoured the development of lighter fan blades in recent years; such blades are typically either of hollow metal or of composite construction. This development has given rise to another problem. Because the blade is lighter, and therefore its resistance to deformation is lower, it is even more difficult to devise a casing arrangement that will resist the passage of ice and yet not interfere with the trajectory of a released fan blade. Furthermore, lightweight swept blades tend to break up, on impact with a fan casing, in a different way from conventional blades, and conventional casing designs are not designed to accommodate this.

In summary, the developments in the gas turbine industry towards, on the one hand, swept fan blades, and on the other, lighter fan blades, have made it increasingly difficult to design a fan casing and containment arrangement that can deliver the three functions required of such an arrangement—namely an abradable fan track, resistance to shed ice and containment of blades or blade fragments.

It is therefore an objective of this invention to provide a gas turbine engine containment assembly that will substantially overcome the problems described above, and that is particularly suited for use with composite, or other lightweight, fan blades.

Embodiments of the invention will now be described, by way of example, making reference to the accompanying drawings in which.

Figure 1:
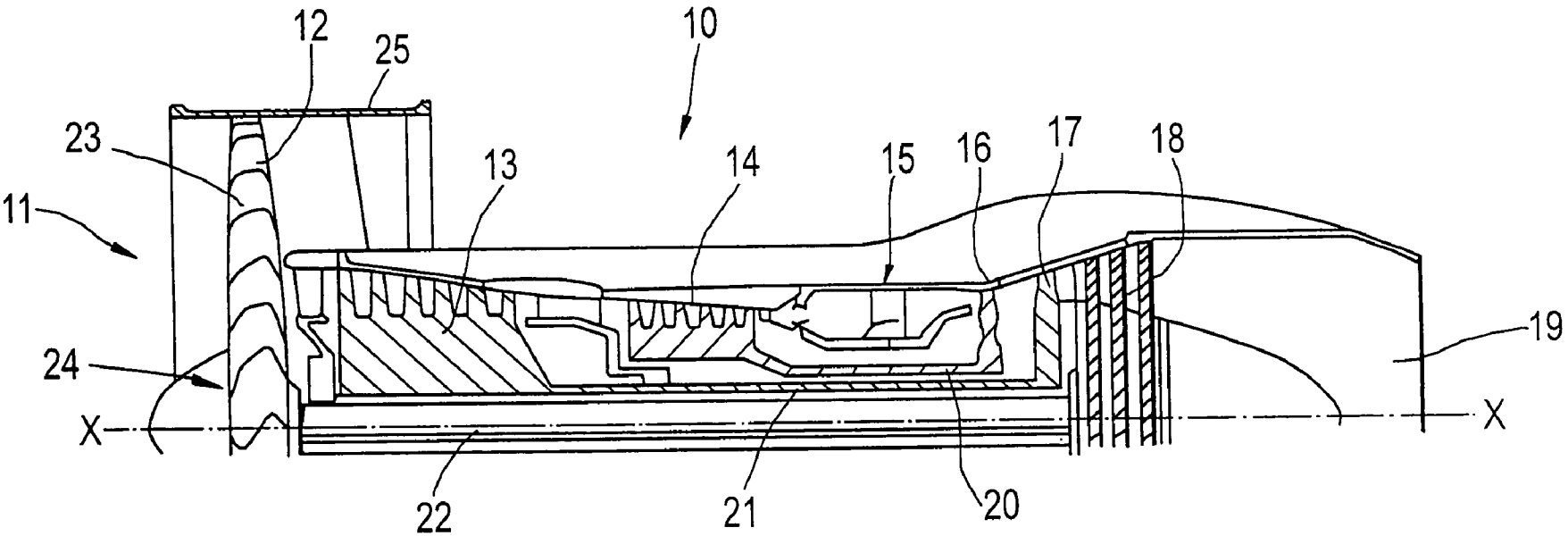
FIG. 1 is a schematic half sectional view of a gas turbine engine of known type.

Referring first to FIG. 1, a gas turbine engine 10 comprises, in axial flow series: an intake 11; fan 12; intermediate pressure compressor 13; high pressure compressor 14; combustor 15; high, intermediate and low pressure turbines 16, 17 and 18 respectively; and an exhaust nozzle 19.

Air enters the engine through the intake 11 and is accelerated by the fan 12 to produce two flows of air, the outer of which is exhausted from the engine 10 through a fan duct (not shown) to provide propulsive thrust. The inner flow of air is directed into the intermediate pressure compressor 13 where it is compressed and then directed into the high pressure compressor 14 where further compression takes place.

The compressed air is then mixed with fuel in the combustor 15 and the mixture combusted. The resultant combustion products then expand through the high, intermediate and low pressure turbines 16, 17, 18 respectively before being exhausted through the exhaust nozzle 19 to provide additional propulsive thrust. The high, intermediate and low pressure turbines 16, 17, 18 drive the high and intermediate pressure compressors 14, 13 and the fan 12, respectively, via concentric driveshafts 20, 21, 22.

The fan 12 comprises a circumferential array of fan blades 23 mounted on a fan disc 24. The fan 12 is surrounded by a fan casing 25, which (together with further structure not shown) defines a fan duct. In use, the fan blades 23 rotate around the axis X-X.

Figure 2B:
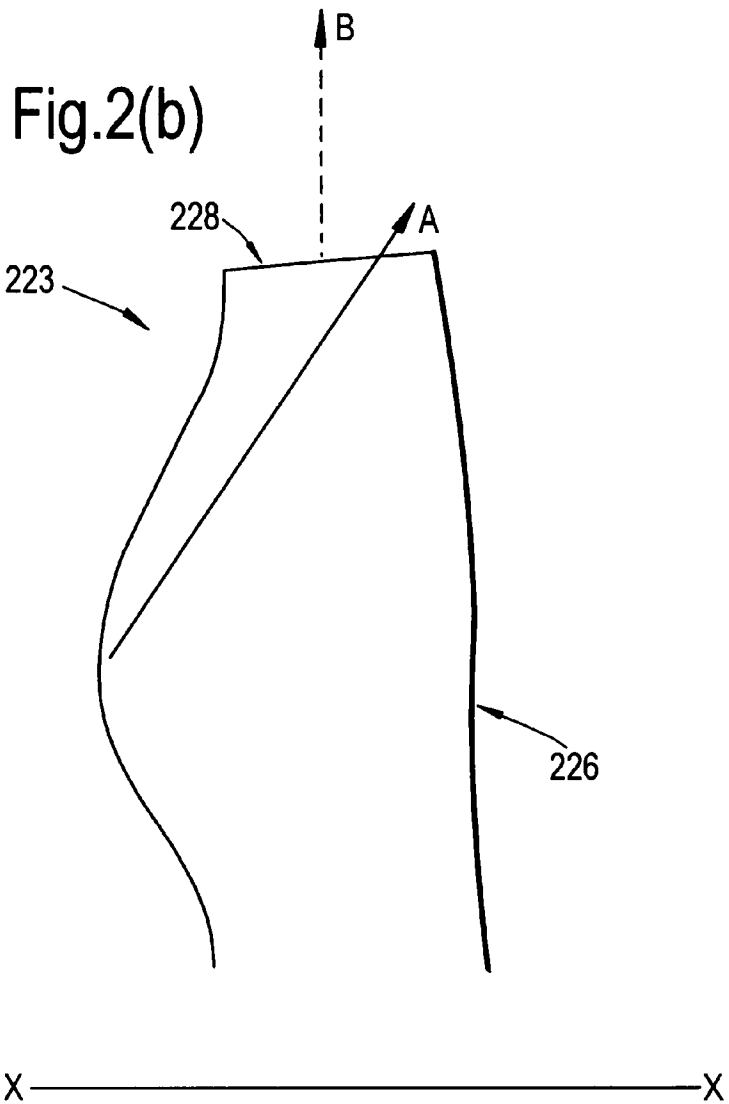
FIG. 2 is a schematic side view of (a) a conventional fan blade and (b) a swept fan blade.
Figure 2A:
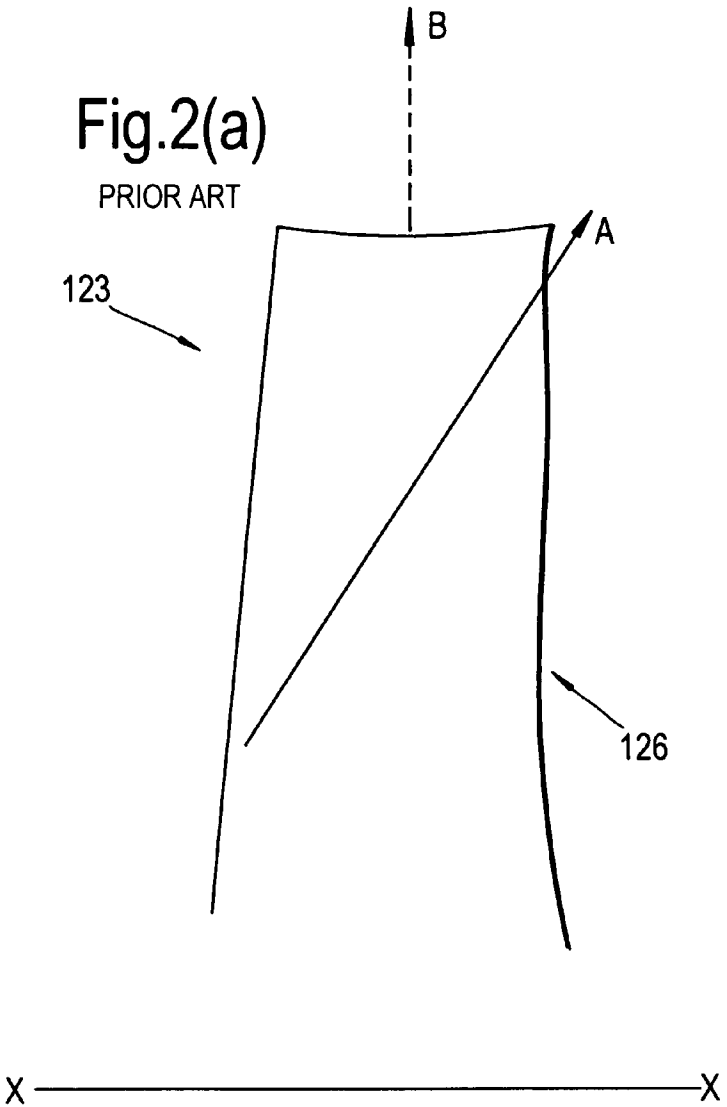
Fig.2(a) PRIOR ART

FIG. 2(*a*) shows a conventional fan blade 123. The arrow A shows a notional path followed by a piece of ice across the surface of the blade 123. The ice is released from the trailing edge 126 of the blade 123, and will therefore hit the ice impact panel rearward of the fan track. In a blade-off event, part or all of a fan blade 123 is abruptly released. The trajectory of the released blade is not significantly affected by gas loads, and so it moves essentially in a radially outward direction as shown by the dashed arrow B, to strike the fan track.

FIG. 2(*b*) shows a swept fan blade 223. The arrow A shows a notional path followed by a piece of ice across the surface of the blade 223. This path is essentially the same as the path followed by the ice across the surface of the conventional fan blade 123, in FIG. 2(*a*). Likewise, the trajectory B of a released fan blade or blade fragment is essentially the same as the trajectory B in FIG. 2(*a*). However, it will be seen in FIG. 2(*b*) that the greater chordal dimension of the swept blade 223 will cause the ice to be released at the tip 228 of the blade, rather than at the trailing edge 226. With a conventional fan casing arrangement, as described above, this ice would then strike the fan track rather than the ice impact panel. The problem is that the energy of impact of the ice may be greater than the local energy of impact of a released blade or blade fragment. Conventional fan casing arrangements must therefore have the mutually contradictory properties that they will permit a released fan blade, or blade fragment, to pass through essentially unimpeded to the containment system, and yet will deflect released ice having a higher energy of impact.

Figure 3:
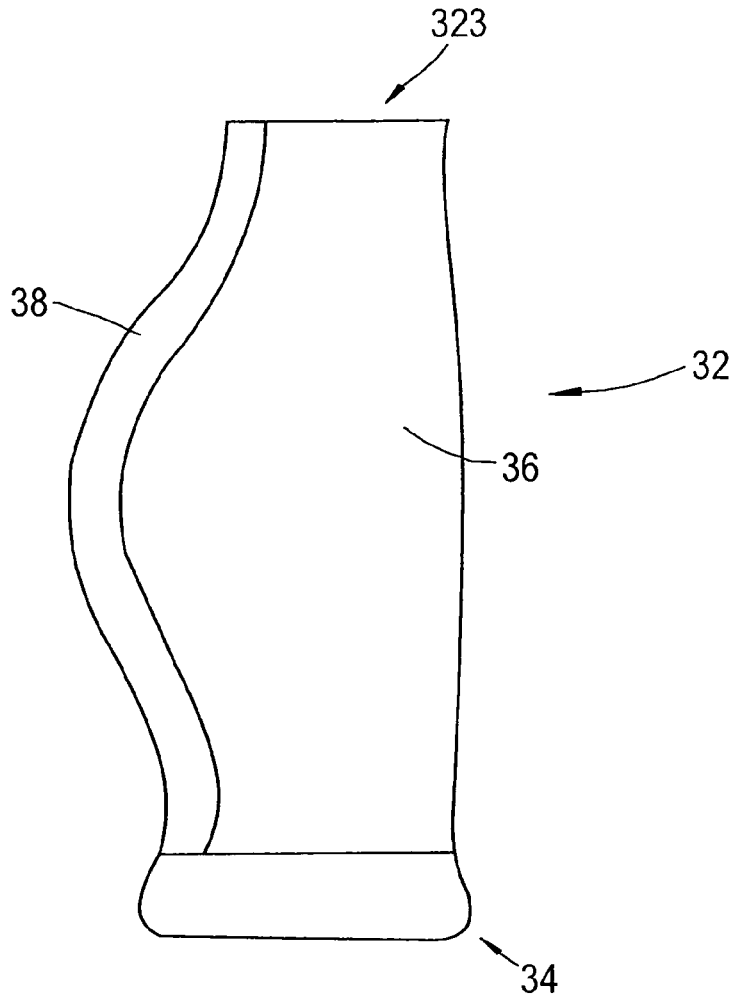
FIG. 3 is a schematic side view of a composite swept fan blade.

In FIG. 3, a composite swept fan blade 323 comprises an aerofoil section 32 and a root section 34. The aerofoil section 32 comprises a body 36, which is formed of composite material, and a leading edge cap 38, which is formed of metal. The leading edge cap 38 provides protection for the body 36 against foreign object damage and erosion in service, which might otherwise lead to debonding and delamination of the composite material.

Figure 4:
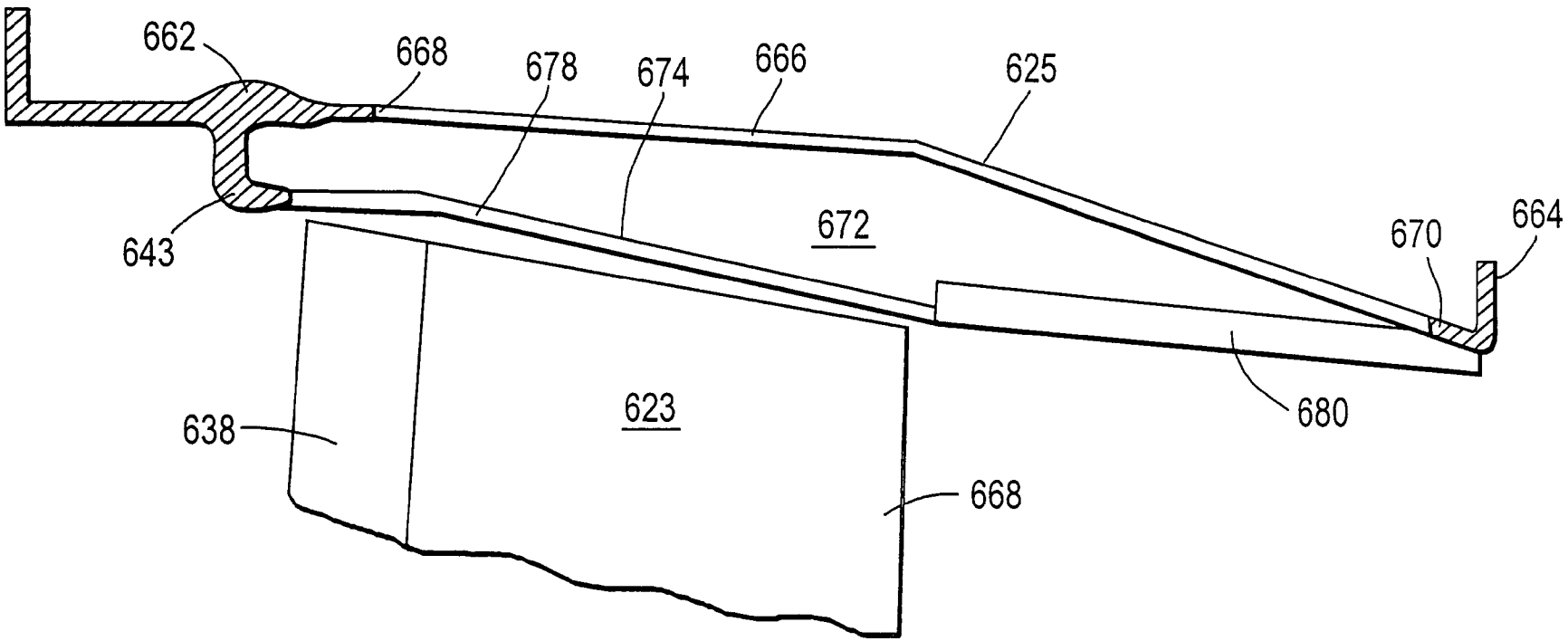
FIG. 4 is a sectional view of a first embodiment of a fan casing according to the invention.

FIG. 4 shows a section through a first embodiment of a fan casing according to the invention. The fan casing 625 extends circumferentially about the gas turbine engine. In use, fan blades 623 of the engine rotate within the fan casing 625. The fan blades 623 are composite swept fan blades of the type shown in FIG. 3.

The fan casing 625 comprises two annular forgings, an upstream (forward) forging 662 and a downstream (rearward) forging 664. The forgings 662, 664 include flanges by which they are attached to the other structure (not shown) of the gas turbine engine. At the forward end of the upstream forging 662 is an annular fan case hook 643, the purpose of which will be explained presently.

Between the upstream 662 and rearward 664 forgings is an annular outer casing 666. The outer casing 666 is welded to the upstream 662 and downstream 664 forgings respectively along weld lines 668 and 670. Radially inward of the outer casing 666 is an annular septum support structure 672. In this embodiment the septum support structure 672 comprises a layer of machined honeycomb material. It could alternatively comprise a layer of metal or polymer foam, or of structural filler. Such materials are well known and will not be described further in this specification. The septum support structure 672 extends axially between the upstream 662 and downstream 664 forgings. The septum support structure 672 is attached to the outer casing 666 by adhesive or by mechanical fasteners.

Attached by adhesive to the radially inward face of the septum support structure 672 is a septum 674. The septum 674 extends forwards to meet the fan case hook 643. The septum 674 is arranged to be relatively stiff and strong, so as to promote the break-up of a blade impacting it. The septum defines a fan track which lies radially outward of the fan blade 623 tips.

The radially inner surface of the septum 674 is covered by an abradable coating 678. In use, the tips of the fan blades 623 cut a path into the abradable layer 678, minimising leakage around the blade tips.

Also attached to the septum support structure 672, and rearwards of the septum 674, is an acoustic liner 680. Such liners are well known, and absorb noise energy produced by the fan blades 623 in use. It is known to attach such acoustic liners by adhesive or by mechanical fasteners.

In the event that a fan blade 623 is released in operation, the blade 623 will impact the abradable coating 678 and septum 674.

As the released fan blade 623 contacts the abradable coating 678 and septum 674, significant compressive load (in the direction of the blade span) builds up, to the point where the strength of the composite material is exceeded.

The body 636 of the fan blade 623 will therefore break up on impact into relatively small fragments, which will be deflected by the septum 674 without causing damage to it, and will be carried away by the air flow. The construction of this part of the fan casing 625, with only an abradable coating 678 covering the septum, will also encourage the breaking up of the fan blade body 636.

The leading edge cap 638, by contrast, is relatively strong and will not readily break up on impact. It will also be contained within the septum 674, although it will not break up (or at least, will not break up to the same extent as the rest of the blade 623). The leading edge cap 638 may be deflected forwards over the radially inner surface of the hook 643. The leading edge cap 638 will therefore also be contained within the fan casing 625.

Figure 5:
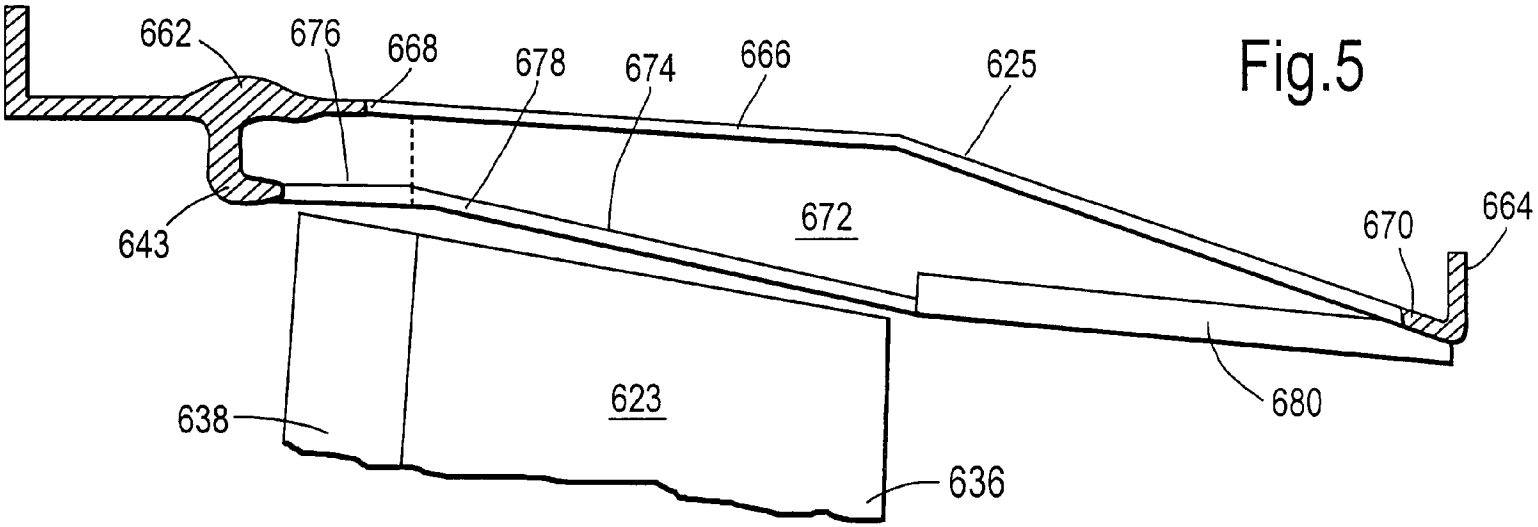
FIG. 5 is a sectional view of a second embodiment of a fan casing according to the invention.

FIG. 5 shows a section through a second embodiment of a fan casing according to the invention. Several features are identical to those shown in FIG. 4, and have been identified by the same reference numbers. The fan casing 625 extends circumferentially about the gas turbine engine. In use, fan blades 623 of the engine rotate within the fan casing 625. The fan blades 623 are composite swept fan blades of the type shown in FIG. 3.

The fan casing 625 comprises two annular forgings, an upstream (forward) forging 662 and a downstream (rearward) forging 664. The forgings 662, 664 include flanges by which they are attached to the other structure (not shown) of the gas turbine engine. At the forward end of the upstream forging 662 is an annular fan case hook 643, the purpose of which will be explained presently.

Between the upstream 662 and rearward 664 forgings is an annular outer casing 666. The outer casing 666 is welded to the upstream 662 and downstream 664 forgings respectively along weld lines 668 and 670. Radially inward of the outer casing 666 is an annular septum support structure 672. In this embodiment the septum support structure 672 comprises a layer of machined honeycomb material. It could alternatively comprise a layer of metal or polymer foam, or of structural filler. Such materials are well known and will not be described further in this specification. The septum support structure 672 extends axially between the upstream 662 and downstream 664 forgings. The septum support structure 672 is attached to the outer casing 666 by adhesive or by mechanical fasteners.

Attached by adhesive to the radially inward face of the septum support structure 672 is a septum 674. The septum 674 extends forwards to meet the fan case hook 643. As in the embodiment of FIG. 4, the septum 674 is arranged to be relatively stiff and strong, so as to promote the break-up of a blade impacting it. However, in contrast to the embodiment of FIG. 4, in this embodiment the upstream (forward) part 676 is arranged to be weaker than the rest of the septum 674. The weaker forward part 676 of the septum 674 is upstream of the region where shed ice would impact the casing, and so the relative weakness of this region is not an issue. The septum defines a fan track which lies radially outward of the fan blade 623 tips.

The upstream (forward) part of the septum support structure 672 (radially outward of the upstream (forward) part 676 of the septum 674, as indicated by the dotted line) is also arranged to be weaker than the rest of the septum support structure 672.

As in the embodiment of FIG. 4, the radially inner surface of the septum 674 is covered by an abradable coating 678.

In the event that a fan blade 623 is released in operation, the blade 623 will impact the abradable coating 678 and septum 674.

As the released fan blade 623 contacts the abradable coating 678 and septum 674, significant compressive load (in the direction of the blade span) builds up, to the point where the strength of the composite material is exceeded. The exception is the relatively stiff leading edge cap, which is better able to resist the compressive forces, survives longer and therefore poses more of a threat to the containment casing.

The body 636 of the fan blade 623 will therefore break up on impact into relatively small fragments, which will be deflected by the septum 674 without causing damage to it, and will be carried away by the air flow. The construction of this part of the fan casing 625, with only an abradable coating 678 covering the septum, will also encourage the breaking up of the fan blade body 636.

The leading edge cap 638, by contrast, is relatively strong and will not readily break up on impact. It will plough through the weaker forward part 676 of the septum 674 (dissipating energy as it does so) and into the weaker forward part of the septum support structure 672, strike the fan casing 625 and be deflected forward so as to engage the fan case hook 643. The leading edge cap 638 will therefore be contained within the fan casing 625.

Alternatively, the fan blades 623 may be hollow metal swept blades of known type. In this type of blade, the hollow central region of the blade is surrounded by a peripheral solid region around the leading and trailing edges and the tip of the blade, sometimes referred to as a "picture frame". In order to provide adequate protection against impacts and foreign object damage, this solid region is thickest at the leading edge of the blade. It will be appreciated that, in use, this solid leading edge region of the blade will behave in a similar manner to the leading edge cap 638 of the composite blade shown in FIG. 5, because (like the leading edge cap 638) it is stiffer and has greater compressive strength than the hollow, central region of the blade. Therefore, the behaviour of such a blade on impact with a fan casing 625 according to the invention will be similar to the behaviour of the composite blade 623 described above—the hollow central region of the blade will break up relatively easily, whereas the solid leading edge region will plough through the weaker forward part 676 of the septum 674, strike the fan casing 625 and be deflected forward so as to engage the fan case hook 643. In this way, the solid leading edge region will be contained within the fan casing 625.

The invention is therefore equally suited to composite and to hollow metal blades, in that the behaviour of the leading edge is specifically catered for in both cases.

In contrast to conventional fan casings, the septum support structure in this invention is designed to contribute significantly to the strength and stiffness of the fan casings. The other parts of the casing can therefore be made simpler and lighter than in conventional arrangements. The relatively stiff and strong septum support structure, in conjunction with the septum, promotes the break-up of a released fan blade. In an embodiment such as that of FIG. 5, the leading edge region of the blade may be allowed to pass through a weaker region of the fan track and into a weaker region of the septum support structure, so that it is contained therein. The contradictory requirements of a conventional fan track—that it should deflect ice yet permit the penetration of a released fan blade—are thereby avoided.

Figure 6:
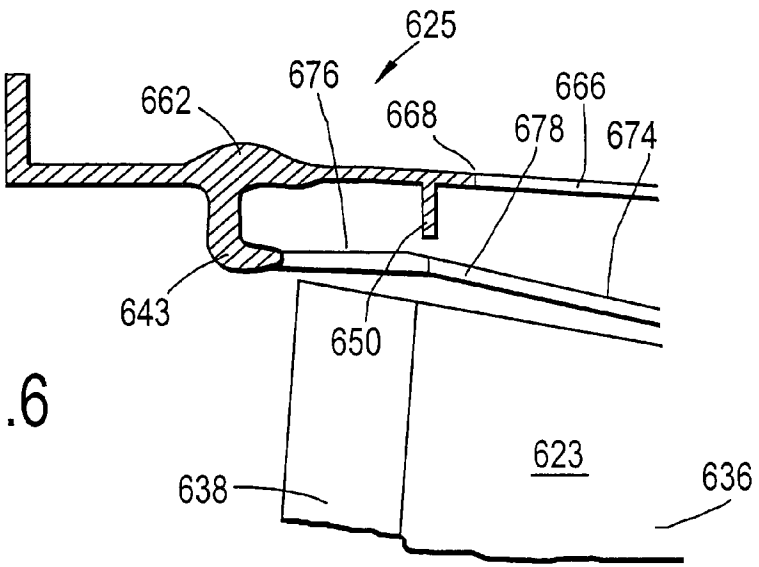
FIG. 6 is a sectional view of the upstream part of a third embodiment of a fan casing according to the invention.

A third embodiment of the invention is illustrated in FIG. 6. Many features correspond with features in the embodiment shown in FIG. 5, and the same reference numbers have been used where appropriate.

In this embodiment, the upstream forging 662 extends somewhat further rearward than in the embodiment of FIG. 5. Extending radially inward from the upstream forging 662 is an annular fence 690. In the event that a fan blade 623 is released in operation, it will strike the fence 690 approximately at the rearward extent of the leading edge cap 638. This will encourage, firstly, the leading edge cap 638 to separate from the body 636 of the blade 623; and, secondly, the leading edge cap 638 to be deflected forwards to engage with the fan case hook 643. The provision of the fence 690 will therefore facilitate the desired blade break-up behaviour described in more detail above, in which the body 636 of the blade breaks up into small pieces while the leading edge cap 638 remains substantially intact and is contained by the fan case 625.

Figure 7:
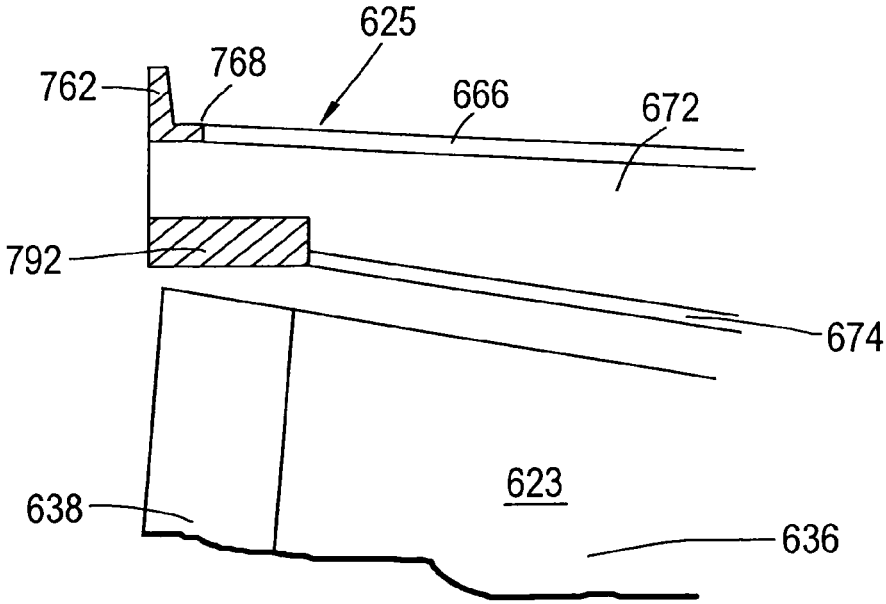
FIG. 7 is a sectional view of the upstream part of a fourth alternative embodiment of a fan casing according to the invention.

FIG. 7 illustrates a fourth alternative embodiment of the invention. Again, many features correspond with features in the embodiment shown in FIG. 5, and the same reference numbers have been used where appropriate.

In this embodiment, the weaker forward part 676 of the embodiments of FIGS. 5 and 6 is replaced by an annular acoustic panel 792. The septum 674 and acoustic panel 792 together define a fan track. This is attached to the septum support structure 672 in conventional manner. As in the embodiment of FIG. 5, the forward part of the septum support structure 672 (radially outward of the acoustic panel 792) may be arranged to be weaker than the rest of the septum support structure 672. In the event that a fan blade 623 is released in operation, the body 636 of the blade will strike the septum 674 and the mechanism of blade break-up will be exactly as described in the embodiment of FIG. 5. The leading edge cap 638 will strike the acoustic liner 792. The mechanical properties of the acoustic liner 792 may be arranged to absorb less or more of the leading edge cap's energy, as desired, so that the leading edge cap 638 either can be contained wholly within the acoustic liner 792 or can be merely guided forwards and outwards through the acoustic liner 792 and subsequently contained within the fan casing 625.

The upstream forging 762 in this embodiment is of simpler design than those in the other embodiments, without the fan case hook shown in the other drawings.

An advantage of this embodiment of the invention is that the presence of the acoustic panel 792 over the upstream part of the fan blade 623, as well as the acoustic panel 680 rearward of the fan blades, will reduce the noise level of the engine in use.

A further advantage of the invention, in all the embodiments described, is that the fan casing 625 generally can be lighter and of simpler design, as it no longer has to contain an entire released fan blade but only the leading edge cap (or, in the case of a hollow metal blade, the solid leading edge region). Specifically, the outer casing 666 can be made significantly thinner than in conventional arrangements. Additionally, in the embodiment of FIG. 7, the acoustic liner 792 can be arranged to absorb some or all of the energy of the released leading edge cap 638, so reducing still further the containment requirements for the fan casing 625.

Because the fan casing is simpler and lighter, different (and cheaper) methods of manufacture may be used to produce it. For example, in the embodiments of FIGS. 4 and 5, the septum support structure could be produced first in foam or honeycomb, and the outer casing, septum and acoustic liner attached to it subsequently, with the abradable coating applied last. Alternatively, the process of manufacture could begin with the outer casing, with the other components built up within it to form the fan casing.

The embodiments of the invention have generally been described with reference to a composite fan blade. However, it is envisaged that the invention would be equally applicable for use with any design of fan blade in which the energy of a released blade would be relatively low, and therefore it would be difficult for the released blade to penetrate the ice impact area of the fan casing—that is, in which the apparent strength of the liner is high.

This might be the case, for example, for a small fan blade of solid construction.

The invention also offers advantages where the leading edge of the fan blade is significantly stiffer and stronger than the other areas of the blade. This includes (but is not limited to) blades made from metal, from foam or from other structural materials, in which the properties of the leading edge are different from those in the body of the blade, as well as blades made from composite materials (for example carbon- or glass-fibre) in which a separate leading edge cap is provided to enhance the protection of the blade against such threats as bird strike, hailstones and erosion.

It will be appreciated that various modifications may be made to the embodiments described in this specification. For example, the fan case hook may be present or absent in any embodiment of the invention. If the fan case hook is present, it will tend to add local stiffness to the fan casing.

The invention therefore provides a containment arrangement more precisely tailored to the manner in which the fan blades deform and break up, and whose design is optimised by providing a mechanism to contain only those parts of the fan blade that need to be contained.

The invention claimed is:

1. A fan casing for a gas turbine engine, the engine comprising a plurality of fan blades that in use rotate about an axis of the engine, the casing comprising:

an annular structure radially outward of the fan blades and extending axially both upstream and downstream of the fan blades, in which in use a fan blade may be released in a generally radially outward direction and strike the casing; and a fan track that in use is radially outward of the plurality of fan blades, the fan track comprising a weakened region so that in use part of a released fan blade can pass into or through the weakened region while a remainder of the released fan blade will be deflected by the fan track, wherein substantially all of the released blade will be deflected by the fan track.

2. The fan casing of claim 1, wherein the weakened region extends only over a leading edge region of the fan blades.

3. The fan casing of claim 1, wherein the weakened region comprises an acoustic liner.

4. The fan casing of claim 1, wherein a radially inner surface of the casing comprises an abradable layer.

5. The fan casing of claim 4, wherein the abradable layer extends over a whole axial length of the fan track.

* * * * *